US007448417B2

(12) United States Patent
Itagaki

(10) Patent No.: US 7,448,417 B2
(45) Date of Patent: Nov. 11, 2008

(54) REINFORCING BAR BINDING MACHINE

(75) Inventor: Osamu Itagaki, Tokyo (JP)

(73) Assignee: Max Co., Ltd., Toyko (JP)

( * ) Notice: Subject to any disclaimer, the term of this patent is extended or adjusted under 35 U.S.C. 154(b) by 0 days.

(21) Appl. No.: 11/632,308

(22) PCT Filed: Jul. 6, 2005

(86) PCT No.: PCT/JP2005/012500

§ 371 (c)(1),
(2), (4) Date: Jan. 12, 2007

(87) PCT Pub. No.: WO2006/008968

PCT Pub. Date: Jan. 26, 2006

(65) Prior Publication Data

US 2007/0199610 A1 Aug. 30, 2007

(30) Foreign Application Priority Data

Jul. 16, 2004 (JP) ..... 2004-210717

(51) Int. Cl.
*B21F 9/02* (2006.01)

(52) U.S. Cl. ..... 140/93.6; 140/93.2; 140/102; 140/118

(58) Field of Classification Search ..... 140/93.2, 140/93.6, 57, 102, 118, 119, 123.6, 149, 140/152; 72/4, 5, 7.1, 7.2, 7.4, 14.8, 14.9, 72/15.3, 135

See application file for complete search history.

(56) References Cited

U.S. PATENT DOCUMENTS

| | | | | |
|---|---|---|---|---|
| 3,804,001 | A * | 4/1974 | Longerich et al. | 100/4 |
| 5,657,799 | A * | 8/1997 | Kusakari et al. | 140/119 |
| 5,694,983 | A * | 12/1997 | Kusakari et al. | 140/119 |
| 6,401,766 | B1 * | 6/2002 | Ishikawa et al. | 140/119 |
| 7,024,901 | B2 * | 4/2006 | Yamaguchi et al. | 72/138 |
| 7,143,792 | B2 * | 12/2006 | Ishikawa et al. | 140/119 |
| 7,275,567 | B2 * | 10/2007 | Ishii et al. | 140/119 |

FOREIGN PATENT DOCUMENTS

| | | |
|---|---|---|
| JP | 9-165918 | 6/1997 |
| JP | 2001-38647 | 2/2001 |
| JP | 2001-140471 | 5/2001 |
| JP | 2003-054511 | 2/2003 |
| JP | 2003-267307 | 9/2003 |

* cited by examiner

*Primary Examiner*—Edward Tolan
(74) *Attorney, Agent, or Firm*—Morgan, Lewis & Bockius LLP

(57) ABSTRACT

A wire feed amount detection mechanism is configured by magnets mounted at an outer peripheral surface of a V-grooved drive gear of a wire feed mechanism and a magnetic sensor mounted on a body. A reinforcing bar winding turn number-setting switch is provided on the body. A control portion controls a wire feed amount of a wire feed mechanism based on a set value of the reinforcing bar winding turn number-setting switch. The number of turns of the wire around reinforcing bars can be arbitrarily set, for example, to any one of 1 to 4, and the binding can be effected with a binding force corresponding to a strength required by binding portions. As a result, with respect to those binding portions requiring a low binding force, the binding is effected with a smaller turn number, so that the amount of consumption of the wire can be saved, and besides those pipes (such as electric wiring pipes and hot water pipes) which are lower in strength than the reinforcing bars can also be bound together.

7 Claims, 4 Drawing Sheets

REINFORCING BAR BINDING MACHINE

This application is a 35 USC 371 of PCT/JP05/12500 filed Jul. 6, 2005.

TECHNICAL FIELD

This invention relates to a reinforcing bar binding machine, and more particularly to a reinforcing bar binding machine in which a number of turns of a wire to be wound around reinforcing bars can be set arbitrarily.

BACKGROUND ART

As labor-saving means for a reinforcing bar binding work, there is an electrically-driven reinforcing bar binding machine for winding a wire around reinforcing bars to bind these reinforcing bars together. One kind of reinforcing bar binding machine is provided with a wire feed mechanism, a wire cutting mechanism, and a wire twisting mechanism, and a wire is fed along a guide nose of a curved shape by the wire feed mechanism, so that reinforcing bars are surrounded by a wire loop, and the wire loop is cut off from the wire extending from a trailing end of the wire loop by the wire cutting mechanism, and at the same time the wire loop is twisted by the wire twisting mechanism to bind the reinforcing bars in closely contacted relation thereto.

The wire feed mechanism employs a pair of V-grooved gears disposed in mesh with each other, and one of the V-grooved gears is driven by a motor, and the other V-grooved gear of a follower type is resiliently contacted with the one V-grooved gear such that the wire is held between the two V-grooved gears, and these V-grooved gears are driven for rotation so as to feed the wire (JP-A-2003-054511, JP-A-2003-267307, etc.). The amount of feed of the wire is controlled on the basis of a number of revolutions of a feed motor or the V-grooved gears, and is set, for example, to an amount corresponding to 4 turns plus $\alpha$, and each time a trigger lever is pulled, the wire is fed in an amount corresponding to 4 turns plus $\alpha$ (which amount is equal to 3 turns around the reinforcing bars plus an additional amount for binding purposes), thereby effecting one cycle of binding operation.

In the above reinforcing bar binding machine, the number of turns of the wire around the reinforcing bars is set to a preset value, but there are those binding portions on which a large load and stresses will not act, and therefore do not require a large binding force. To provide a multiplicity of turns of the wire at such binding portions leads to waste of the wire. Also, there is a case where it is desired to effect the binding with a force larger than a preset binding force; however, when a twisting torque is increased while using the preset number of turns, the wire is twisted off, and therefore it is necessary to increase the number of turns. Furthermore, it may be proposed to apply the reinforcing bar binding machine to other uses than the binding of reinforcing bars, such for example as the binding of resin-made pipes for electric wiring and the binding of hot water heating pipes. However, a binding force required for the pipes of this kind is not so large as the binding force required for the reinforcing bars, and when the wire is wound in a multiplicity of turns as is the case with the reinforcing bars, this leads to waste of the wire, and besides there is a fear that the pipes are broken with a large binding force.

DISCLOSURE OF THE INVENTION

In accordance with one or more embodiments of the present invention, there is provided a reinforcing bar binding machine in which a number of turns of a wire to be wound around reinforcing bars can be set arbitrarily so as to obtain a necessary binding force, and also an amount of consumption of the wire can be saved.

In accordance with one or more embodiments of the present invention, a reinforcing bar binding machine is provided with a wire feed mechanism for feeding a wire (wound around a wire reel mounted on a tool body) to a guide nose portion of a curved shape and for winding the thus fed wire as a wire loop of a generally loop-shape around a binding object, a wire cutting mechanism for cutting the wire off from the wire extending from a trailing end of the wire loop, a wire twisting mechanism for twisting the cut-off wire loop to bring the wire loop into intimate contact with reinforcing bars, thereby binding the reinforcing bars, a turn number-setting mechanism for setting a number of turns of a winding of the wire loop, a wire feed amount detection mechanism for detecting an amount of feed of the wire, and a control portion for controlling the amount of feed of the wire on the basis of a set value set by the turn number-setting mechanism and a feed amount detection value detected by the wire feed amount detection mechanism. The wire loop, having an arbitrary number of turns, can be formed.

Further, in accordance with one or more embodiments of the present invention, the control portion controls a twisting torque of the wire twisting mechanism on the basis of the set value of the turn number-setting mechanism. The twisting operation is carried out with the twisting torque corresponding to the number of turns of the wire loop.

Further, in accordance with one or more embodiments of the present invention, the wire feed amount detection mechanism includes a rotation detection mechanism which detects rotation of a wire feed member (which forms part of the wire feed mechanism so as to feed the wire) or rotation of a rotation shaft portion of a drive source of the wire feed member.

Further, in accordance with one or more embodiments of the present invention, the rotation detection mechanism includes a magnet member mounted on a rotation portion of the wire feed member or the rotation shaft portion of the drive source of the wire feed member, and a magnetic sensor member mounted on the tool body.

Further, in accordance with one or more embodiments of the present invention, there is provided the reinforcing bar binding machine characterized in that the wire twisting mechanism includes an electric motor serving as a drive source, and the control portion controls a driving current of the electric motor so as to control the twisting torque.

Other aspects and advantages of the invention will be apparent from the following description and the appended claims.

BRIEF DESCRIPTION OF THE DRAWINGS

FIG. 4(*b*) is a front-elevational view of a wire loop having a winding turn number "2".

FIG. 4(*c*) is a front-elevational view of a wire loop having a winding turn number "3".

FIG. 4(*d*) is a front-elevational view of a wire loop having a winding turn number "4".

DESCRIPTION OF THE REFERENCE NUMERALS

Figure 1:
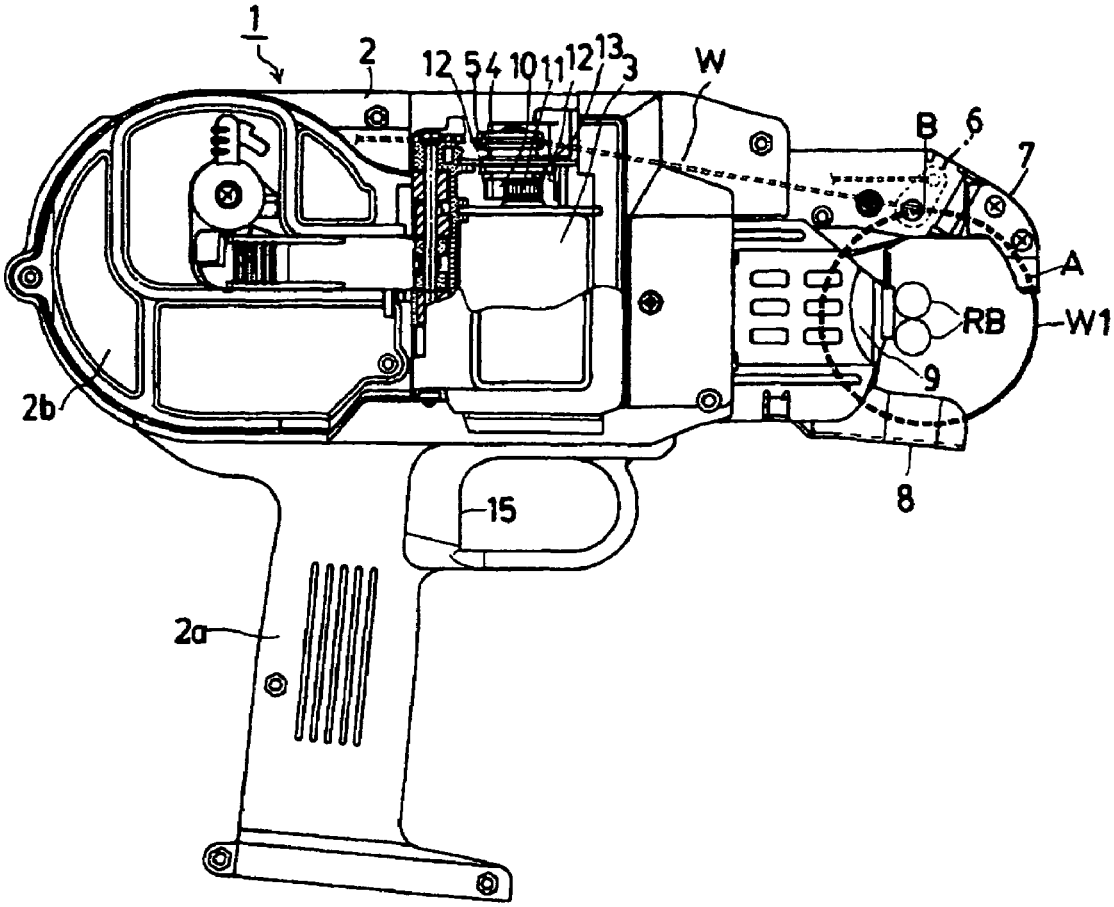
FIG. 1 is a side-elevational, cross-sectional view of a reinforcing bar binding machine of one or more embodiments of the present invention.

1 reinforcing bar binding machine
2 housing
2*a* grip portion
2*b* wire reel receiving portion
3 wire feed motor
4 V-grooved drive gear
5 V-grooved driven gear
6 rotary wire cutter
7 wire guide nose
8 lower guard
11 gear
12 magnet
13 wire feed amount detection sensor
14 reinforcing bar winding turn number-setting switch

BEST MODE FOR CARRYING OUT THE INVENTION

One or more embodiments of the present invention will now be described with reference to the drawings.

First Embodiment

Figure 2:
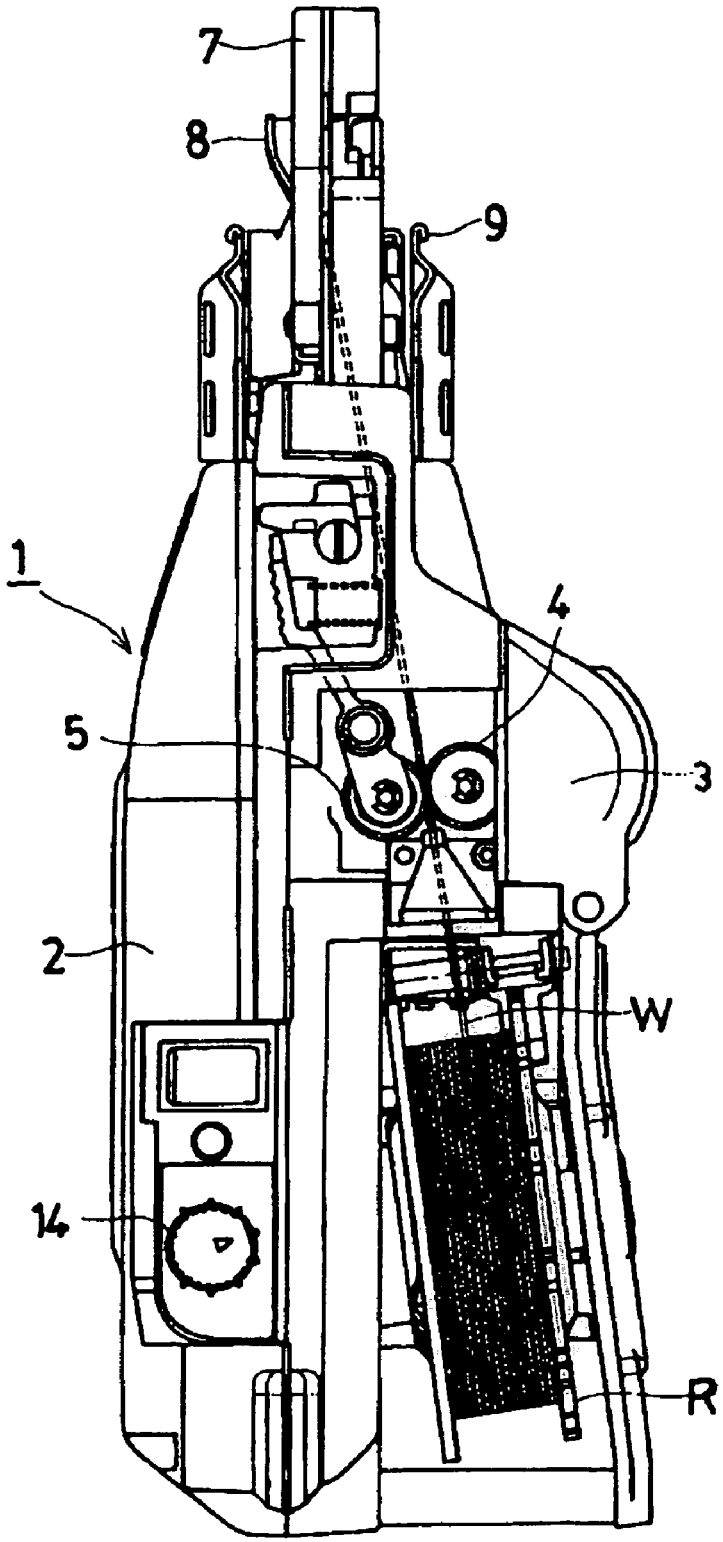
FIG. 2 is a plan, cross-sectional view of the reinforcing bar binding machine of FIG. 1.

FIGS. 1 and 2 show a reinforcing bar binding machine 1. A wire reel receiving portion 2*b* is formed at a rear portion of a housing 2 having a grip portion 2*a*. A wire feed motor 3 is provided as a drive source. A wire feed mechanism is located forwardly of the wire reel receiving chamber 2*b*, and comprises a V-grooved drive gear 4 which is provided as a wire feed member, and is driven by the wire feed motor 3, and a V-grooved driven gear 5 which is provided as the wire feed member, and is disposed in mesh with the V-grooved drive gear 4 in resiliently contacted relation thereto.

As shown in FIG. 2, a wire W wound around a wire reel R within the wire reel receiving chamber 2*b* is gripped by the V-grooved drive gear 4 and the V-grooved driven gear 5, and is fed forward, and passes a rotary wire cutter 6 (shown in FIG. 1) serving as a wire cutting mechanism, and is fed to be curved in a generally arc-shape along a wire guide nose 7 of a curved shape to form a wire loop W1.

A control portion 16 stops the feeding of the wire after the wire W is fed out in an amount corresponding to a set turn number. At this time, a distal end of the wire W is disposed at a distal end (at a position A in FIG. 1) of the wire guide nose 7. Then, a pair of hooks (not shown) of a wire twisting mechanism, disposed inside a hook cover 9 provided between the wire guide nose 7 and a lower guard 8, advance to grip the wire loop W1. In accordance with the advancing movement of the hooks, the wire cutter 6 cuts a trailing end of the wire loop at a position B (in FIG. 1), thereby cutting the wire loop off from the wire extending from the trailing end of the wire loop. Subsequently, the hooks are driven and rotated to twist the gripped portion of the wire loop, thereby binding reinforcing bars RB together, and when a twisting torque of a wire twisting motor 19 (which is an electric motor serving as a drive source) rises to a certain set value, the twisting operation is stopped. Thereafter, the wire twisting motor is rotated in a reverse direction to open the hooks to return these hooks to their respective initial positions, thus finishing one cycle of binding process.

As shown in FIG. 1, a gear 10 provided at a lower portion of the V-grooved drive gear 4 is in mesh with a gear 11 of the wire feed motor 3, and four magnets 12 serving as a rotation detection mechanism are embedded in an outer peripheral surface of a shaft portion of the V-grooved drive gear 4, and are spaced an angle of 90 degrees from one another. A wire feed amount detection sensor 13, which is provided as a rotation detection mechanism within the housing, and is a magnetic sensor such as a Hall element, is disposed in opposed relation to a magnet mounting portion of the V-grooved drive gear 4. The amount of rotation of the V-grooved drive gear 4 is detected by the wire feed amount detection sensor 13, and the control portion controls the amount of feed of the wire on the basis of a gear rotation amount detection value.

As shown in FIG. 2, a reinforcing bar winding turn number-setting switch 14 of the rotary type is provided at an upper surface of the housing 2, and reinforcing bar winding turn number graduations (not shown) respectively indicating 1 to 4 turns are engraved around the reinforcing bar winding turn number-setting switch 14. The actual turn number of the wire winding is the number of turn(s) around the reinforcing bars plus (one turn+$\alpha$) which is used for binding purposes, and therefore when the turn number "1" for the winding around the reinforcing bars is selected, the wire is fed in an amount corresponding to 2 turns+$\alpha$.

Figure 3:
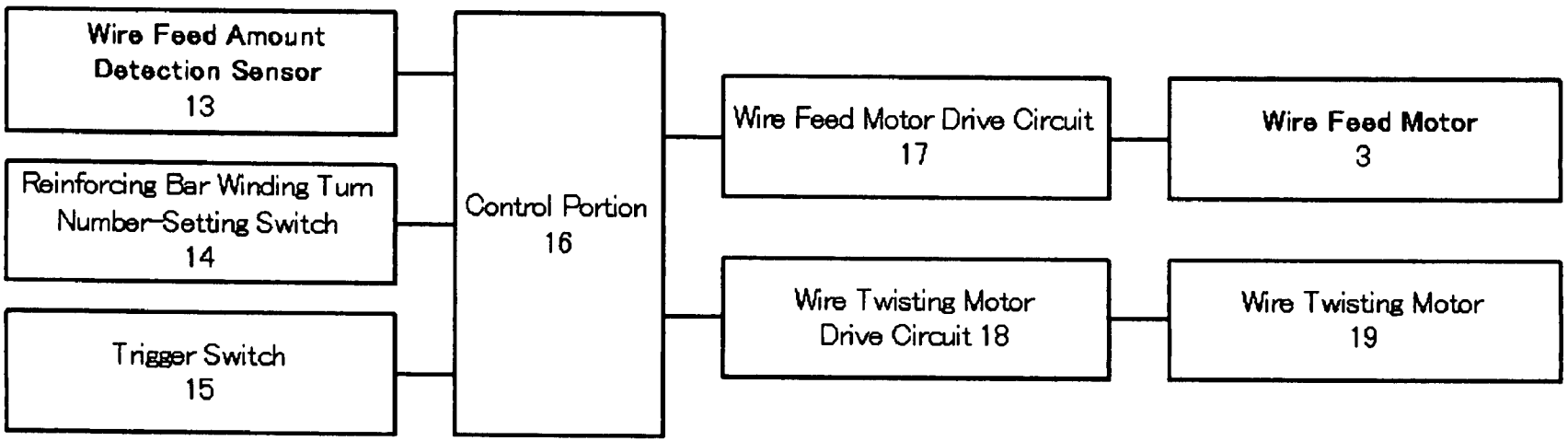
FIG. 3 is a circuit block diagram of the reinforcing bar binding machine of FIG. 1.
Figure 4A:
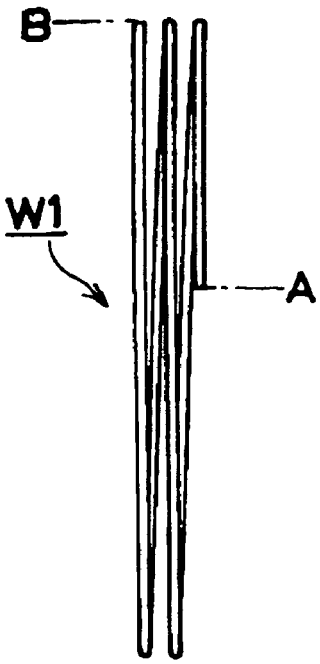
FIG. 4(*a*) is a front-elevational view of a wire loop having a winding turn number "1".
Figure 4B:
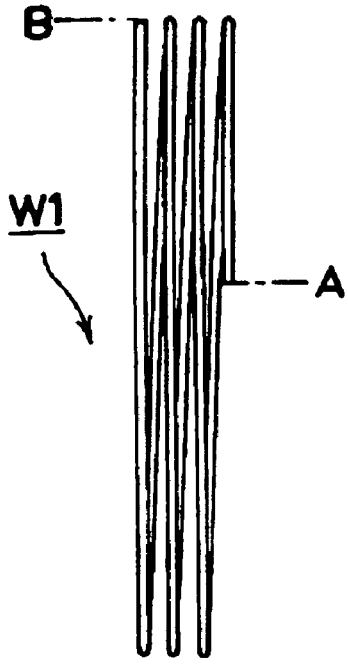
Figure 4C:
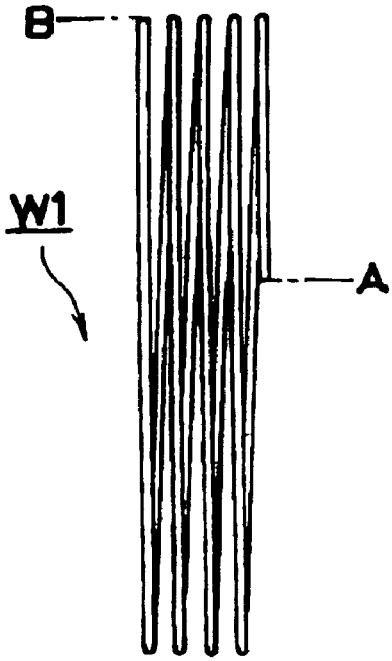
Figure 4D:
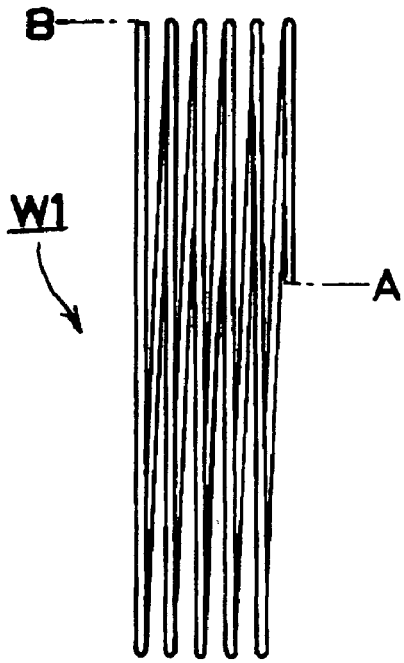

FIG. 3 is a circuit block diagram of the reinforcing bar binding machine 1, and the wire feed amount detection sensor 13, the reinforcing bar winding turn number-setting switch 14 serving as a turn number-setting mechanism, and a trigger switch 15 are connected to an input circuit of the control portion 16. The trigger switch 15 is turned on, and at this time on the basis of an input signal from the reinforcing bar winding turn number-setting switch 14, a wire feed motor drive circuit 17 is controlled so as to drive the wire feed motor 3, and a wire twisting motor drive circuit 18 is controlled so as to drive the wire twisting motor 19. A driving torque of the wire twisting motor 19 gradually increases, corresponding to the indicated graduations of the reinforcing bar winding turn number-setting switch 14, and is automatically set so that the wire twisting motor 19 can be driven with a twisting torque suitable for the number of turns of the wire around the reinforcing bars. Namely, with each of the turn number "1" to the turn number "4" for the winding around the reinforcing bars, the twisting torque is controlled to such a value that the objects to be bound together will not become loose and also that the wire will not be ruptured.

FIGS. 4(*a*) to 4(*d*) are views of wire loops W1 (formed by the wire feed step) as seen from the front side of the reinforcing bar binding machine. FIG. 4(*a*) shows the case where the winding turn number is "1" (2 turns+$\alpha$), FIG. 4(*b*) shows the case where the winding turn number is "2" (3 turns+$\alpha$), FIG. 4(*c*) shows the case where the winding turn number is "3" (4 turns+$\alpha$), and FIG. 4(*d*) shows the case where the winding turn number is "4" (5 turns+$\alpha$). Reference character A denotes the leading end of the wire loop W1 which corresponds to a portion A in FIG. 1, and reference character B denotes the trailing end (cutting point) of the wire loop W1 which corresponds to a portion B in FIG. 1.

Thus, the turn number of the wire can be arbitrarily set, and for example with respect to an ordinary reinforcing bar binding portion, the turn number is set to "3", and the operation is carried out, and with respect to resin-made electric wiring pipes, the turn number is set to "1", and with respect to those reinforcing bar binding portions which do not require a large binding force, the turn number is set to "2", and with respect to those reinforcing bar binding portions which require a higher binding force than usual, the turn number is set to "4". Thus, the binding can be effected with the binding force corresponding to the binding objects, and besides the amount of consumption of the wire can be reduced.

This invention is not limited to the above embodiment, and various modifications can be made within the technical scope of this invention, and it is apparent that this invention covers such modifications.

For example, the above embodiment is constructed such that the wire twisting torque is automatically set according to the number of turns of the winding wire so that one of the predetermined twisting torques can be selected. However, the construction may be so modified that the wire twisting toque can be manually adjusted within a predetermined range, using the thus automatically-set wire twisting torque as a reference.

Furthermore, the reinforcing bar winding turn number-setting switch 14 does not need to be limited to the rotary switch as in the above embodiment, and may comprise a see-saw switch or a toggle switch, and it may be of any type in so far as the operator can arbitrarily set the turn number of the winding wire.

Furthermore, in the above embodiment, in view of the environment of use of the reinforcing bar binding machine in which much dirt and dust are present so that the rotation detection mechanism is required to have a relatively high resistance to stain, the magnetic sensor, comprising the magnets and the Hall element or the like, is used as the rotation detection mechanism. However, instead of this construction, a photo sensor, a rotary encoder or others can be used, and in short it is only necessary to be able to detect the rotation.

While the invention has been described in detail with reference to the specific embodiments, it will be apparent to those skilled in the art that various modifications and variations can be made without departing from the spirit or scope of the invention.

The present Application is based on Japanese Patent Application (Japanese Patent Application No. 2004-210717) filed on Jul. 16, 2004, the contents of which are incorporated herein by reference.

INDUSTRIAL APPLICABILITY

In accordance with one or more embodiments of the present invention, a reinforcing bar binding machine is constructed such that an amount of feed of a wire is controlled according to a number of turns of a wire loop set by a wire loop turn number-setting mechanism so that a binding can be effected with an arbitrary turn number. Therefore, the binding can be effected with a binding force corresponding to a strength required by binding portions, and with respect to those binding portions requiring a low binding force, the binding is effected with a smaller turn number, so that waste of the wire can be suppressed, and besides those pipes (such as electric wiring pipes and hot water pipes) which are lower in strength than the reinforcing bars can also be bound together.

In accordance with one or more embodiments of the present invention, the reinforcing bar binding machine is provided with a wire feed amount detection mechanism, a wire loop turn number-setting mechanism, and a control portion for controlling an amount of feed of the wire on the basis of the set value set by a turn number-setting mechanism and a feed amount detection value detected by the wire feed amount detection mechanism. Therefore, a wire loop having an arbitrary number of turns can be formed, and a binding can be effected with a binding force corresponding to a strength required by binding portions, and besides waste of the wire can be suppressed.

The invention claimed is:

1. A reinforcing bar binding machine comprising:

a wire feed mechanism for feeding a wire and for winding the wire as a wire loop around a binding object;

a turn number-setting switch for setting a number of turns of a winding of the wire loop;

a wire feed amount detection mechanism for detecting an amount of feed of the wire; and a control portion for controlling the amount of feed of the wire based on a set value set by the turn number-setting switch and a feed amount detection value detected by the wire feed amount detection mechanism.

2. The reinforcing bar binding machine according to claim 1, further comprising:

a wire reel having the wire wound thereon;

a guide nose portion having a curved shape;

a wire cutting mechanism for cutting the wire loop off from the wire extending from a trailing end of the wire loop; and a wire twisting mechanism for twisting the cut-off wire loop to bring the wire loop into intimate contact with reinforcing bars and bind the reinforcing bars.

3. The reinforcing bar binding machine according to claim 2, wherein the control portion controls a twisting torque of the wire twisting mechanism based on the set value of the turn number-setting mechanism.

4. The reinforcing bar binding machine according to claim 3, wherein the wire twisting mechanism includes an electric motor as a drive source; and the control portion controls a driving current of the electric motor so as to control the twisting torque.

5. The reinforcing bar binding machine according to claim 1, wherein the wire feed mechanism includes a wire feed member;

the wire feed amount detection mechanism includes a rotation detection mechanism; and the rotation detection mechanism detects rotation of one of a rotation portion of the wire feed member and a rotation shaft portion of a drive source of the wire feed member.

6. The reinforcing bar binding machine according to claim 5, wherein the rotation detection mechanism includes a magnet member mounted on the one of the rotation portion of the wire feed member and the rotation shaft portion of the drive source of the wire feed member, and a magnetic sensor member mounted on a tool body.

7. The reinforcing bar binding machine according to claim 1, wherein the turn number-setting switch comprises a rotary type switch in which winding turn number graduations are engraved around the turn number-setting switch.

* * * * *